United States Patent [19]

Shifferly

[11] Patent Number: 4,953,238

[45] Date of Patent: Sep. 4, 1990

[54] SANITIZING SPRAY SEAT FOR TOILET

[76] Inventor: John P. Shifferly, 5729 Estancia Dr., Apt. No. 2232, Orlando, Fla. 32822

[21] Appl. No.: 342,529

[22] Filed: Apr. 24, 1989

[51] Int. Cl.[5] ..... E03D 9/08

[52] U.S. Cl. ..... 4/420.2; 4/420.4; 4/447; 4/448

[58] Field of Search ..... 4/420.1–420.5, 4/443–448

[56] References Cited

U.S. PATENT DOCUMENTS

| | | | |
|---|---|---|---|
| 1,091,499 | 3/1914 | Friedman | 4/420.5 |
| 1,663,111 | 3/1928 | Campus | 4/420.5 |
| 1,668,048 | 5/1928 | Campus | 4/420.5 |
| 1,855,008 | 4/1932 | Callejo | 4/420.5 |
| 1,872,278 | 8/1932 | Guidetti et al. | 4/420.5 |
| 1,949,415 | 3/1934 | Guidetti et al. | 4/447 |
| 1,966,951 | 7/1934 | Guidetti | 4/420.5 |
| 1,990,268 | 2/1935 | Crane | 4/447 |
| 2,600,619 | 6/1952 | Conterno | 4/420.4 |
| 2,852,782 | 9/1958 | Sundberg | 4/420.4 |
| 3,781,919 | 1/1974 | Ayala | 4/447 |
| 3,845,509 | 11/1979 | Lieber | 4/420.5 |
| 4,092,744 | 6/1978 | Butoi | 4/447 |
| 4,197,594 | 4/1980 | Butterfield | 4/448 |
| 4,327,451 | 5/1982 | Baus | 4/420.2 |
| 4,441,219 | 4/1984 | Epstein | 4/448 |
| 4,807,311 | 2/1989 | Ingels | 4/443 |

FOREIGN PATENT DOCUMENTS

| | | | |
|---|---|---|---|
| 51982 | 5/1982 | European Pat. Off. | 4/445 |
| 565704 | 8/1957 | Italy | 4/420.4 |
| 376590 | 7/1932 | United Kingdom . | |
| 2142054 | 1/1985 | United Kingdom | 4/420.4 |

*Primary Examiner*—Henry J. Recla
*Assistant Examiner*—R. M. Fetsuga
*Attorney, Agent, or Firm*—Julian C. Renfro

[57] ABSTRACT

A sanitizing spray device in accordance with this invention is designed for use on a toilet having a seat member, and comprises an elongate, generally tubular member having a spray device adjacent one end. The arrangement is such that water at a selected temperature and quantity is connected to said generally tubular member, so that water can be caused to travel for a portion of the length of the tubular member, and then issue as a spray of warm water from said spray device. A mounting device is provided under the seat member for pivotally mounting the generally tubular member at a location intermediate its ends. The mounting device is advantageously constructed to permit the generally tubular member to be readily swung from a recessed position in which it principally resides under the confines of the seat member, to a deployed position in which the spray device is in approximately a central location with respect to the principal aperture of the seat member and the bowl of the toilet. The generally tubular member is also mounted for rotation about its own longitudinal axis. Thus, a user sitting on the toilet seat can readily cause a sanitizing spray of water of appropriate temperature to be directed upwardly at a selected angle at the private parts of the user.

11 Claims, 3 Drawing Sheets

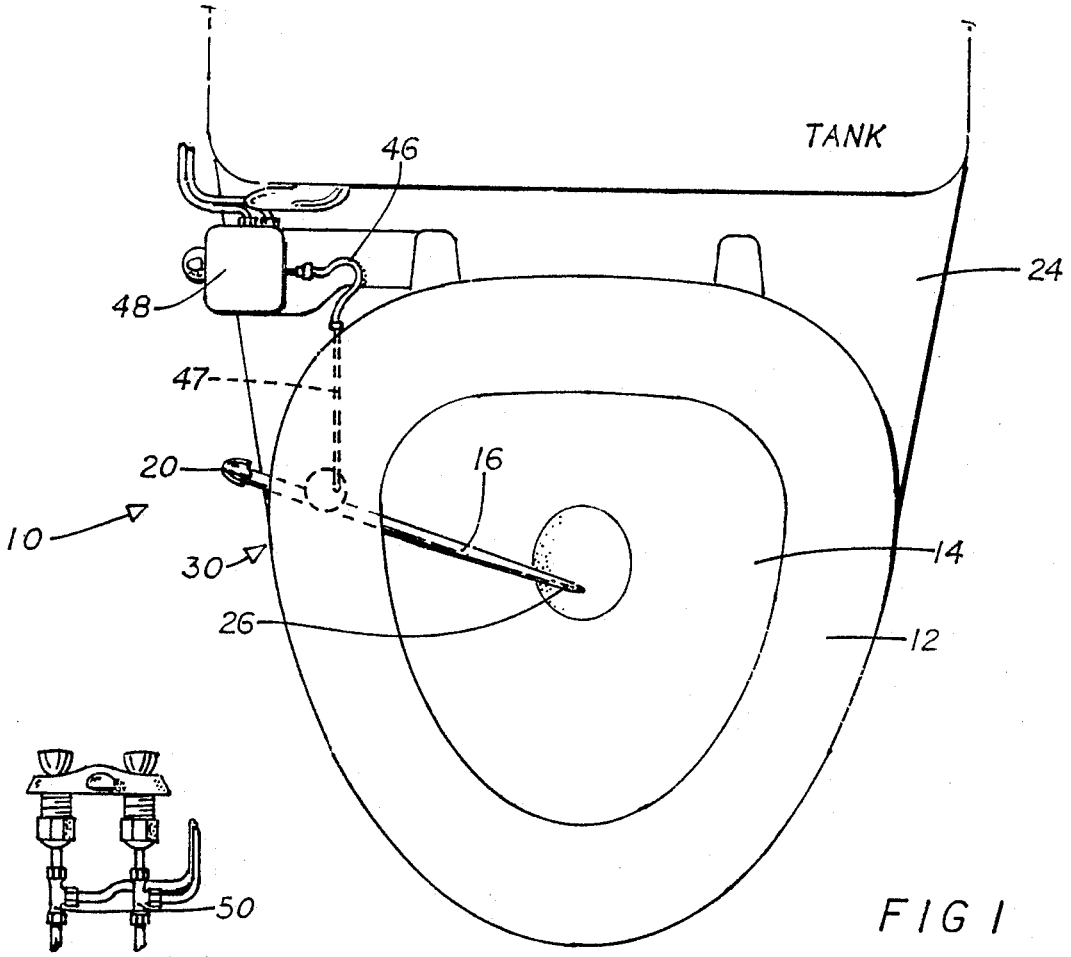
FIG 1
FIG 1a
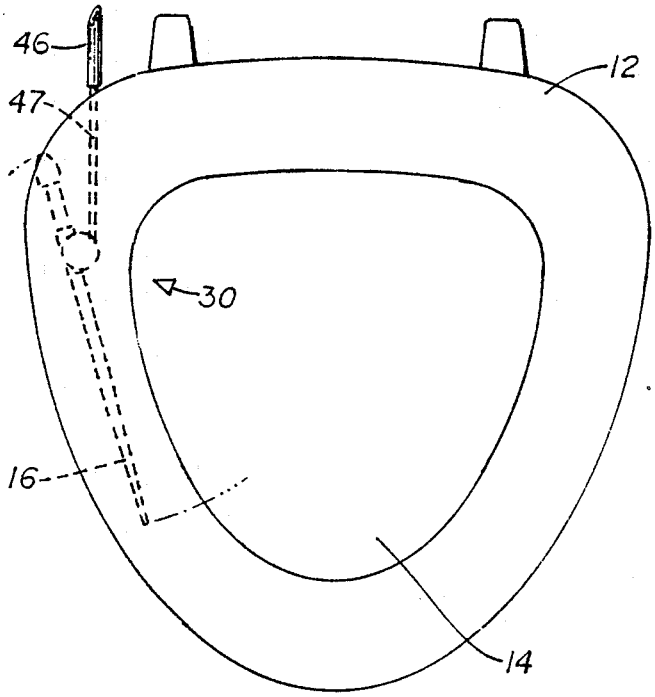
FIG 2
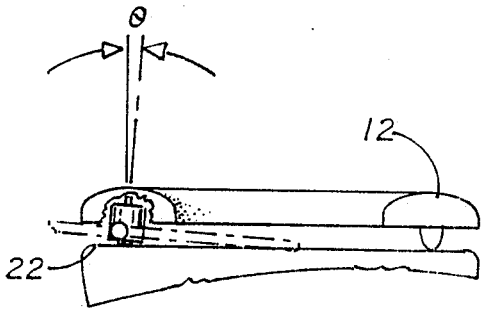
FIG 3
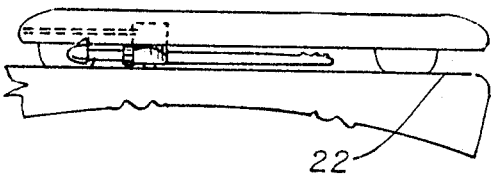
FIG 4

FIG 5
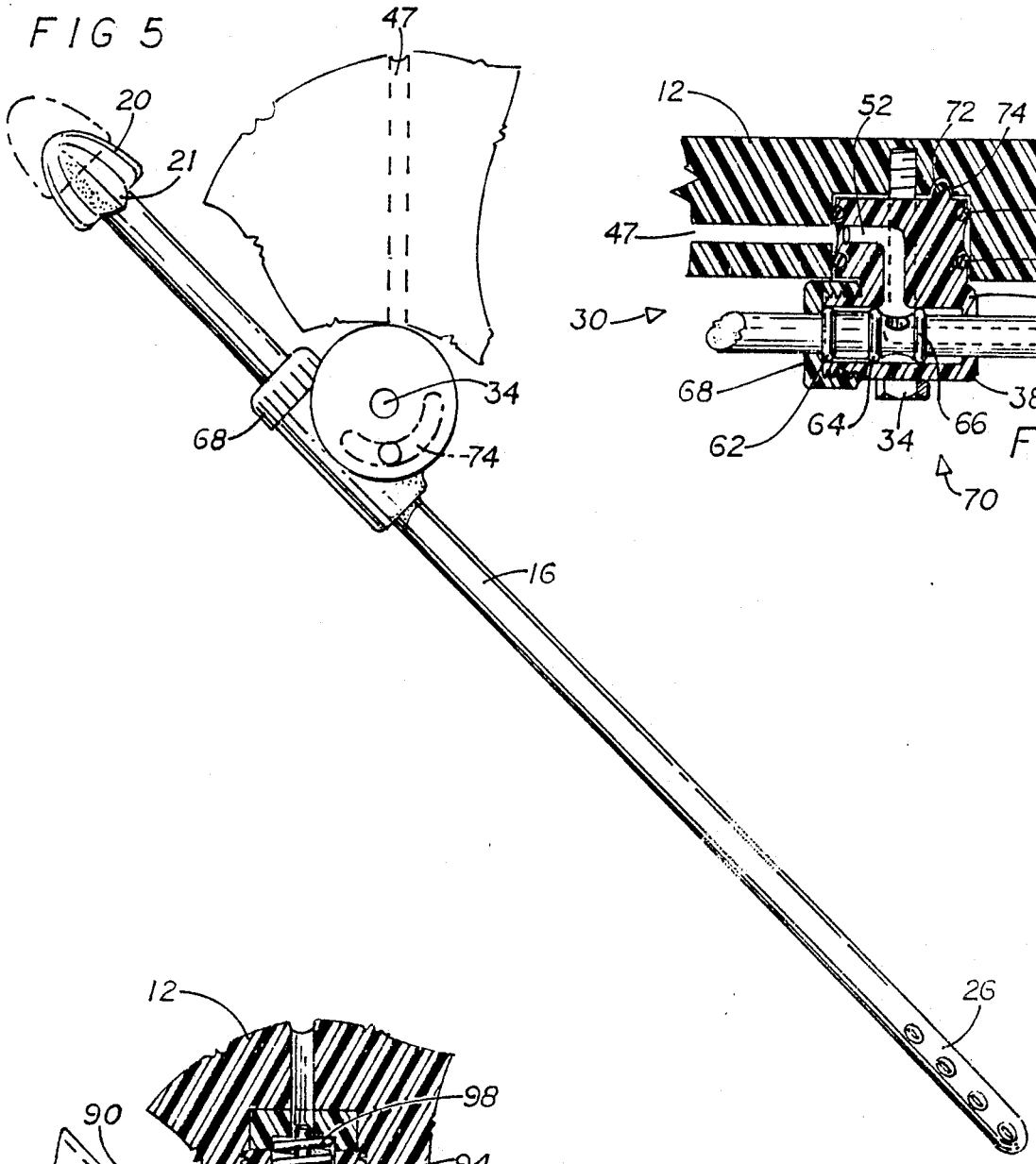
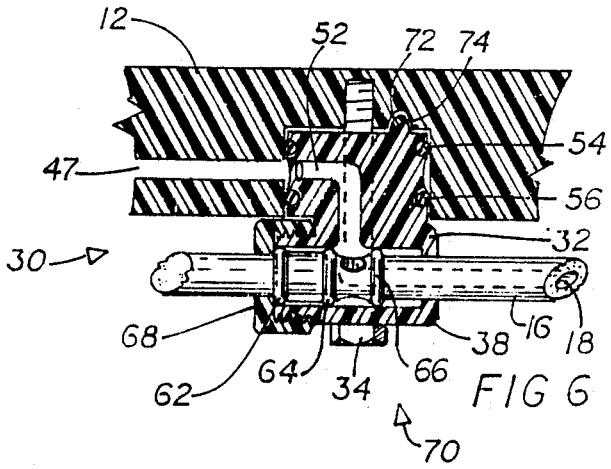
FIG 6
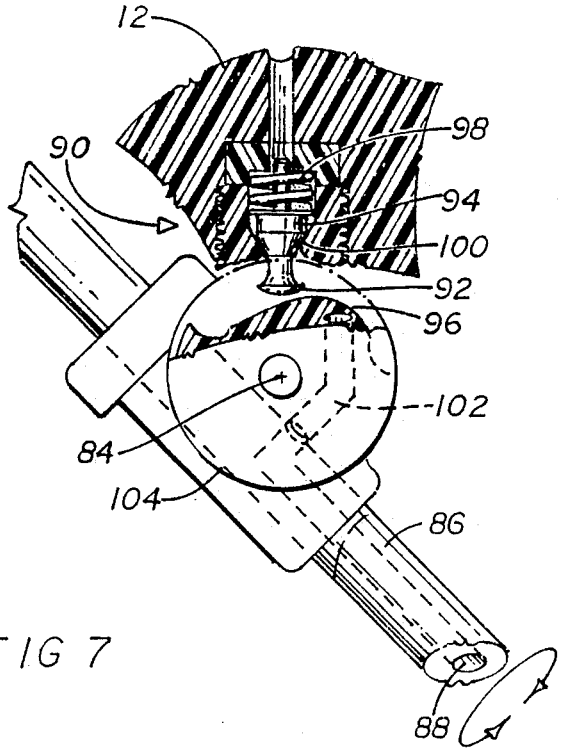
FIG 7
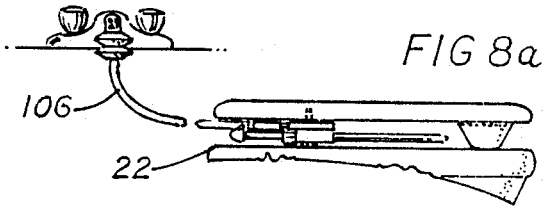
FIG 8a
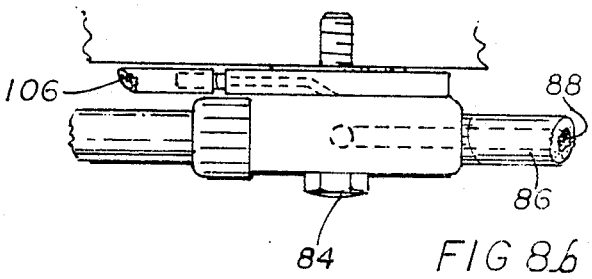
FIG 8b

SANITIZING SPRAY SEAT FOR TOILET

BACKGROUND OF THE INVENTION

In the past, a number of sanitizing devices and spray devices have been proposed for utilization on toilets and bidets, with the Friedman Pat. No. 1,091,499 entitled "Bidet" and the Campus Pat. No. 1,663,111 entitled "Lavatory" being typical of the early prior art.

As pointed out in the Guidetti et al Pat. No. 1,872,278, entitled "Flushing Arm for Sanitary Water Closet Attachments," in such devices, water under pressure issuing from a nozzle will be projected upwardly, sometimes with a rearwardly inclined direction, such that fluid under pressure will strike directly against the body outlet of the occupant of the seat in connection with which the cleansing operation is to be performed.

In the Guidetti device, a water delivery arm is movable between two extreme positions, the underside of the rim of the toilet bowl or bidet bowl being just about the level that the nozzle will occupy. Guidetti expressed a concern with sanitary considerations with the earlier devices, so he concluded it to be preferable for the flushing or water delivery arm to remain normally in a position where the water used to flush the bowl cannot reach or contaminate the water delivery arm.

The Guidetti approach was to mount the arm on the toilet bowl, or at least support it by the toilet bowl in what he regarded as being a sanitary location. His water delivery arm was stated to be movable from an inoperative position above the bowl, to an operative position within the bowl, with the arm being subjected to both a translatory movement and a rotatory movement.

The later Guidetti Pat. No. 1,966,951 entitled "Sanitary Water Closet" repeated some of the same themes and involved a "pocket" being created in the upper part of a toilet bowl to accommodate the movable flushing arm.

The Lieber Pat. No. 3,845,509 entitled "Bidet-Commodes" involved a design usable either as a toilet or as a bidet.

All of these prior art devices involved designs in which the user had to go to the considerable expense of creating a location in his or her bathroom to accommodate a bidet, or else he or she had to undertake the expense of modifying an existing toilet or bidet in order to utilize the new features being made available.

As will be seen hereinafter, the present invention can be utilized quite effectively for a variety of purposes, without the user having to undertake any consequential expense, and without requiring a portion of a bathroom to be dedicated to a bidet that is unusable as a dual purpose bidet and toilet.

SUMMARY OF THE INVENTION

A sanitizing spray device in accordance with this invention is usable on a wide variety of toilets of the type that are equipped with a toilet seat movable between raised and lowered positions. Although my device is ideally suited for use by a woman as a bidet, it is also usable by a person of either gender that suffers from a distressing condition such as hemorrhoids, so it is for this reason that I am unwilling for my device to be categorized solely as a bidet.

Instead of being mounted on or adjacent the toilet bowl, and necessitating an extensive amount of plumbing effort, my invention involves the use of an elongate, generally tubular member supported by a mounting means attached to the underside of the toilet seat. The generally tubular member has a spray means adjacent one end, and is movable between a recessed position in which the entire sanitizing spray device is under one part of the toilet seat, and an active or deployed position in which the spray means located at the end of the elongate member is disposed in what may be regarded as the center of the principal aperture of the toilet seat, which of course usually coincides with the center of the toilet bowl.

The arrangement in accordance with this invention is such that the user is able to control the entry of hot and cold water to the device, such that water at a selected temperature and pressure is supplied to the generally tubular member. The warm water travels for a portion of the length of the tubular member, and then issues from the spray means adjacent the end of the generally tubular member.

In accordance with one embodiment of my invention, the elongate, generally tubular member is equipped adjacent a mid portion with a water valve of the "pull on, push off" type, such that the user can readily proceed from a condition in which no water is issuing from the spray means, to a condition in which a substantial amount of water is issuing therefrom.

In accordance with another embodiment of my invention, the swinging movement of the elongate, generally tubular member controls the movement of a valve means with regard to an adjacent cam, such that no water issues from the spray means until the spray means has reached the approximate center of the aperture in the toilet seat and the toilet bowl.

A further advantage is involved in my invention, which is that of the elongate, generally tubular member is mounted in such a manner as to permit it to be twisted about its longitudinal axis. This arrangement enables the user to point the spray of water emanating from the end of the generally tubular member downwardly into the bowl of the toilet until it has been ascertained that the temperature is appropriate, being neither too hot nor too cold. Then, when the water has been brought to the appropriate temperature by the manipulation of the hot and cold water valve or valves, the user twists the elongate, generally tubular member about its longitudinal axis in order to bring the spray of warm water up into contact with the desired body opening at the selected and most appropriate angle.

When the rinsing operation has been completed, the user then swings the elongate, generally tubular member back to the location in which it resides under one portion of the toilet seat. This is a location in which it is completely out of contact with the water that is thereafter utilized to flush the toilet.

As should be obvious, by mounting my novel sanitizing spray seat on the toilet, it is possible to enjoy the advantages of a bidet without having to allocate space in perhaps an already overcrowded bathroom for the accommodation of a bidet fixture on the floor of the bathroom. Cost savings are quite large, for it is likewise unnecessary to reconfigure the toilet or the toilet bowl in any manner, which also would obviously have entailed considerable expense.

My novel sanitizing spray device is of such a nature as to be readily incorporated into a toilet seat at the factory, meaning of course that the home owner need only discard his or her present toilet seat, and replace it with a toilet seat configured to accommodate my novel sanitizing spray device. As an alternative, another embodiment of my novel sanitizing spray device can be added directly to an existing toilet seat, at a minimum of expense and with minimal installation difficulty.

It is therefore to be seen that a principal object of my invention is to provide a sanitizing spray device of low to moderate cost, that can be readily supported from a more or less conventional toilet seat, and kept in an out-of-the-way position when not in use.

It is another object of my invention to provide a sanitizing spray device of minimal expense, that can be incorporated at the factory into a more or less conventional toilet seat, or alternatively added by a retrofit operation to the underside of an existing toilet seat.

It is still another object to provide a sanitizing spray device in which the user can select a desired temperature of the water to be used for cleansing selected body openings, with the user being able to use one hand to feel the appropriateness of the water temperature while adjusting water temperature with the other hand, prior to the spray of warm water being directed at the most appropriate angle into sanitizing contact with the selected portion of the user's body.

It is yet still another object of my invention to provide a readily affordable sanitizing spray device equally adaptable for factory installation or installation on a do-it-yourself basis, which will have a full range of operational capabilities, and which will not in any way compromise a conventional toilet for use in accordance with its original intent.

These and other objects, features and advantages will be more apparent from a study of the appended drawings.

BRIEF DESCRIPTION OF DRAWINGS

FIG. 1 is a plan view of a toilet that has been fitted with my novel sanitizing spray device, usable with water temperature selection means, and with an elongate, generally tubular member constituting an important portion of my device being disposed in a position in which the spray means at the end of the generally tubular member is in the active position;

FIG. 1*a* is a fragmentary view of a typical supply of hot and cold water to a mixing control utilized to supply water at a selected temperature to the spray means;

FIG. 2 is a plan view much like that shown in FIG. 1, except that my novel, generally tubular member has been moved to a recessed position in which it is out of the way;

FIG. 3 is a fragmentary front view of a toilet seat, showing how the pivot point about which the elongate, generally tubular member is swung can be tilted away from the vertical, so that the generally tubular member will pass clear of the user's bottom;

FIG. 4 is a view similar to FIG. 3, but showing a side view of my novel sanitizing spray device while in the storage or recessed position;

FIG. 5 reveals the appearance of the elongate, generally tubular member in accordance with this invention, when being used with a valve means of the "pull on, push off" type, with this view further revealing one type of spray means utilized at the end of the generally tubular member;

FIG. 6 is a vertical, sectionalized view revealing the components utilized for supporting the elongate, generally tubular member in a relationship that permits the generally tubular member to be swung around a supporting pivot member in moving between active and stored positions, as well as the generally tubular member being able to be twisted about its longitudinal axis for the convenience of the user;

FIG. 7 is an alternative embodiment to a larger scale, this involving a type of valve means in which water is permitted to flow along the generally tubular member and issue from the spray means only at such time as the generally tubular member has been swung into the active position indicated in FIG. 1;

FIG. 8*a* is a view of an embodiment of the type in which my novel sanitizing spray device can be added by the home owner to the underside of the conventional toilet seat, with customary hot and cold water controls being usable in order that water of the proper force and proper temperature will issue from the spray means;

FIG. 8*b* is a view to a larger scale of the embodiment shown in FIG. 8*a*, to reveal pertinent constructional details;

DETAILED DESCRIPTION

Figure 9:
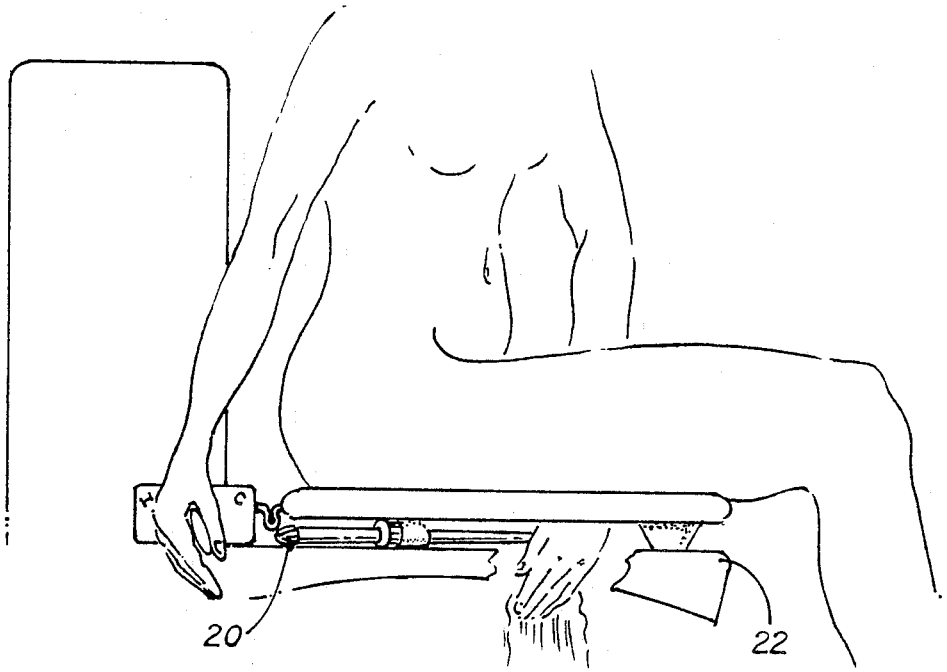
FIG. 9 is a view of a person seated on a toilet seat that has been modified in accordance with my invention, revealing how the user can use one hand to feel the temperature of the downwardly directed spray of water, while the other hand is utilized to control the water temperature.

With initial reference to FIG. 1, it will there be seen that my novel sanitizing spray device 10 has been mounted below a more or less conventional toilet seat 12, with a spray means 26 located on the end of the device 10 being shown in a central portion of the aperture 14 of the toilet seat 12.

My sanitizing spray device 10 is principally constituted by an elongate, generally tubular member 16, clearly visible in FIG. 5, adjacent one end of which member the spray means 26 is located. The generally tubular member 16 has a central passage 18 through which water on occasion is caused to flow; note FIG. 6.

This embodiment of my elongate, generally tubular member 16 is pivotally mounted at a location below one part of the toilet seat 12 by the mounting means 30 depicted in FIG. 6. As will be explained in some detail hereinafter, the rotatable housing member 32 of the mounting means 30 is preferably secured by a principal pivot member or bolt 34, to the underside of the toilet seat 12. This pivotal mounting readily permits the user to swing the elongate, generally tubular member 16 about the pivot member 34 from the active or deployed position shown in FIG. 1, to the recessed or inactive position depicted in FIG. 2, and vice versa.

Figure 10:
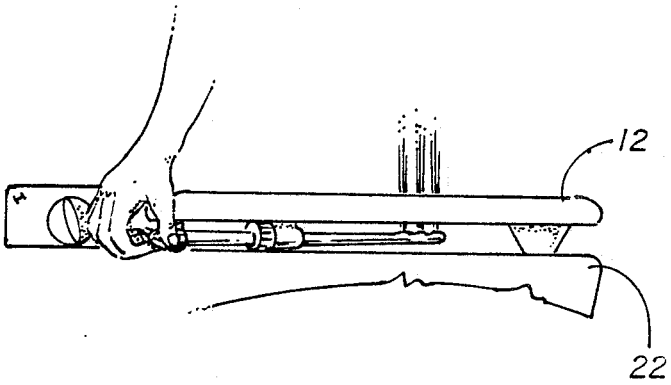
FIG. 10 is a view similar to FIG. 9 but with the user not being shown, and with the spray of water of selected temperature being indicated to flow upwardly at the most desirable angle as a result of my novel elongate, generally tubular member having been twisted about its longitudinal axis.

Figures such as FIG. 4, FIG. 8*a* and FIG. 10 reveal the compact nature of each embodiment of my novel device 10, which resides between the underside of the toilet seat 12 and the upper edge 22 of the toilet bowl 24. Advantageously, the utilization of my sanitizing spray device does not necessitate an extensive modification to an existing toilet, or in any way compromise the toilet's use for the originally intended purpose.

Water is supplied to the housing of the mounting means 30 by the use of the flexible tube 46; note FIGS. 1 and 2. Water is carried from the tube 46 to the embodiment of my device revealed in FIGS. 5 and 6 by virtue of a longitudinally disposed interior passage 47 drilled or otherwise formed parallel to the plane of the seat 12, which passage makes effective contact with the various components that constitute this embodiment of my invention. These components will be discussed shortly.

Figure 11:
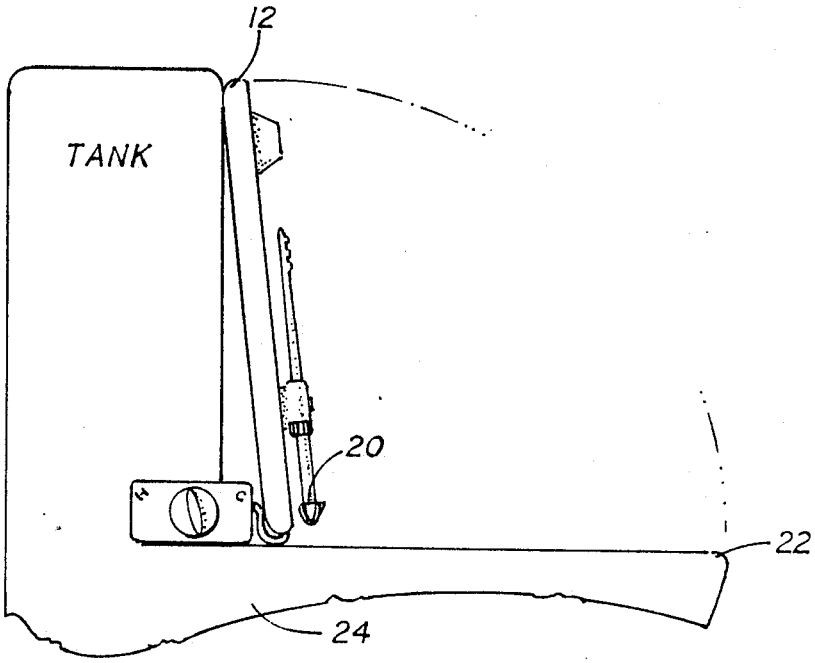
FIG. 11 is a view showing how it is still possible to tilt the toilet seat for use by a male, without this impairing the future utilization of my novel sanitizing spray device.

Because it is desirable for the toilet seat 12 on occasion to be lifted in a conventional manner from the lowered position shown in FIGS. 3 and 4, to the raised position shown in FIG. 11, it is highly desirable for the tubing 46 to be of a flexible nature, such as of plastic, as will permit the toilet seat to be moved up and down a very large number of times without the tubing cracking or splitting.

Tube 46 is in turn connected to a type of mixing control 48 as depicted in FIG. 1, in conjunction with which are shown separate pipes for hot and cold water that are connected to the control device. The control device 48 may be of the single lever type. As is obvious, the user can readily move a single lever on the control 48 to the position appropriate for bringing about water of a carefully selected temperature flowing through the tube 46 and the spray means 26.

In FIG. 1*a* I reveal that as a possible alternative to the single lever mixing control 48, I can utilize a mixing control 50 having separate hot and cold water faucets to be manipulated by the user as she (or he in some instances) goes about achieving a desirable water temperature. The type of mixing control depicted in FIG. 1*a* is particularly well adapted for use with certain embodiments of this invention, such as with the "swing on" embodiment of my invention revealed in FIG. 7.

Turning now to the embodiment of my invention principally revealed in FIGS. 5 and 6, the elongate, generally tubular member 16 here is rotatably mounted so as to be able to be swung by the user about the pivot 34, between the active and inactive positions shown in FIGS. 1 and 2. The lower, generally cylindrically shaped portion 38 of rotatable housing member 32 is configured to receive a mid portion of the elongate, generally tubular member 16, in a non-leak manner permitting tubular member 16 to be twisted by the user about its longitudinal axis, for a purpose shortly to be described at some length.

The generally tubular member 16 is also movable longitudinally by the user for a limited extent with respect to the cylindrically shaped portion 38, this longitudinal movement being in a direction coincident with the longitudinal axis of the tubular member 16. By selective movements of the tubular member along its longitudinal axis, the user is able to effectively control the flow of water through the member 16 and the spray means 26, as will shortly be explained in greater detail.

As revealed in FIG. 6, the principal pivot member or bolt 34 can be disposed vertically, and have threads that threadedly engage a threaded interior portion of the toilet seat 12, so that the rotatable housing member 32 as well as the generally tubular member 16 will be properly and securely supported. As an alternative, the axis of rotation of the mounting means 30 can be inclined at an angle $\theta$ to the vertical, as generally depicted in FIG. 3, so that when the generally tubular member 16 is swung about principal pivot member 34, the member 16 will move through a downwardly inclined plane, and avoid striking the bottom of the user. This latter may well have happened if the tubular member 16 swung in a precisely horizontal plane.

It is important to understand with regard to the cylindrically shaped portion 38 of the housing member 32, in which the mid portion of the elongate, generally tubular member 16 is received, that the construction is such as to readily permit the elongate, generally tubular member 16 to be slidable for valving purposes in a direction coinciding with its own longitudinal axis. This permits a type of valve means 70 to be used such that when the user grasps the knob 20 of the tubular member 16 and pulls the knob in the direction away from the pivot 34, this causes the commencement of the flow of water from the spray means 26. On the other hand, upon the user thereafter pushing the knob 20 of the tubular member 16 toward the pivot 34, the flow of water is caused to cease.

In FIG. 5, the knob 20 depicted in its full-line position indicates the position in which the flow of water has been stopped, whereas when the knob has been pulled by the user into its dashed line position, water will then be flowing from the spray means 26. Indicia such as a small arrow 21 may be used on the knob 20, so that the user can readily ascertain therefrom, the rotative position of the generally tubular member 16. As a result of this feature, the user can establish from the feel and/or the appearance of the knob 20, the particular orientation of the spray means 26 at a given moment.

For obvious reasons, I prefer to call the embodiment of my invention depicted in FIGS. 5 and 6, the "Pull on, Push off" embodiment.

With continuing reference to FIG. 6, it is to be noted that in the interior of the rotatable housing member 32 is a passageway 52 serving to convey warm water from the seat passage 47 to the interior of the elongate, generally tubular member 16. The entrance to passageway 52 is wide enough as not to inhibit the entry of water from the passage 47, irrespective of the particular rotational position of the housing member 32 with regard to the toilet seat 12.

In order to prevent undesirable leakage, O-rings 54 and 56, or other suitable seals, are utilized on the exterior of the rotatable housing member 32. As best seen in FIG. 6, seal ring 54 is located above the terminus of passage 47, whereas seal ring 56 is located below it.

FIG. 6 reveals the valving arrangement in the open position, such that water from passageway 47 can flow out through the spray means 26. As will be noted in this figure, a plurality of O-rings are utilized on the mid portion of the generally tubular member 16, these being O-rings 62, 64 and 66. The outer circumferential portions of the O-rings are in proper contact with the cylindrically shaped interior of the portion 38.

It is to be realized that an opening into the interior of the generally tubular member 16 is provided between O-rings 64 and 66, so that water entering through passages 47 and 52 can thereafter flow along the central passage 18 of the generally tubular member 16.

As will be apparent, O-ring 62 is provided to prevent an undesirable flow of water through the cylindrically shaped portion 38, such that drippage would occur at the location where threaded closure member 68 is provided.

O-rings 64 and 66 serve to help channel the entering water into the central passage 18 of the generally tubular member, and as is obvious, if the generally tubular member 16 is moved out of the open valve condition revealed in FIG. 6, the O-ring 64 will move into a position in which the further flow of water into the interior passage of the generally tubular member is effectively prevented. The construction of this embodiment of my invention is preferably such as to permit the user to be able to selectively modulate the flow of water through the spray means 26, by slight longitudinal movements of the knob 20.

It is usually desirable to prevent the generally tubular member from being swung too far, and to that end, I may provide an upper abutment 72 on the top of the rotatable housing member 32; note FIG. 6. An arcuate slot 74 is provided directly above the abutment member 72, as shown in FIG. 5, in which the upper abutment 72 travels as the elongate, generally tubular member 16 is swung between its active and stored positions.

With reference to FIG. 7, it will there be seen that I have there revealed an embodiment in which a valve means 90 is provided in the rotatable housing member 32, that serves to control the flow of water into the generally tubular member 86. The generally tubular member 86 is to be understood to be equivalent to the previously described generally tubular member 16, and include a similar if not identical spray means (not shown). It will be noted that some of the reference numerals of the embodiment of FIG. 7 bear a relationship with the numerals of the first described embodiment.

The valve means 90 is sensitive to the position in which the elongate, generally tubular member has been swung with respect to the center opening of the toilet seat. Thus, upon the user causing the generally tubular member 86 to swing about the principal pivot point 84, the flow of water along the inner passage 88 of the generally tubular member 86 will be caused to commence only when the spray means has reached the general vicinity of the center of the principal aperture of the seat member, and of course the approximate center of the bowl of the toilet.

With further regard to the valve means 90, a portion 92 of the valve member 94 is designed to ride along cam surface 96, with the valve member 94 normally being biased by a spring 98 into the closed position, that is, with the tapered valving surfaces of the valve member 94 being in contact with the seat 100.

When as a result of the generally tubular member 86 being swung from the stored position toward the active or operational position in the center of the toilet seat aperture, the movement of the cam rider 92 of the valve member 94 along the cam surface 96 will gradually open the valve means 90, and permit water to flow through passage 102 located near the end of the cam surface 96. The passage 102 of the mounting means 104 opens into the central passage 88 of the generally tubular member 86. As is obvious, such water then flows out of the spray means located adjacent the end of the generally tubular member 86.

It should now be apparent that by having a comparatively shallow cam surface 96, the arrangement can be such that the flow of warm water from the spray means of the tubular member 86 gradually commences. On the other hand, the cam 96 can be designed to be steep, with the consequence being that the flow of warm water from the spray means will have a sudden onset. In many instances I find the latter arrangement preferable.

As revealed in FIGS. 8*a* and 8*b*, I am not limited to an arrangement in which an elongate passage 47 of the type shown in FIGS. 5 and 6 is utilized, for as shown in these latter two figures, my sanitizing spray device can be manufactured for retrofit to an existing toilet seat. In this instance, I prefer for the plastic tubing 106 to extend all the way from the valves associated with the source of hot and cold water, to the housing member serving to support the generally tubular member 86.

As in the previous embodiment, the construction just described is such as to permit the elongate, generally tubular member 86 to be twisted about its longitudinal axis between the positions illustrated in FIG. 9 and FIG. 10. This feature gives the user the option of being able to direct the water spray from the member 86 onto private body parts at the most advantageous angle, with regard to the particular circumstance involved.

FIG. 8*b* reveals that this embodiment of my invention can be applied to the undersurface of an existing toilet seat, and thereby entirely obviate any need to hollow out any portion of the bottom of the seat, or any need to drill a longitudinal hole through the seat, for as previously mentioned, the plastic tubing 106 can extend all the way to the support member utilized for supporting the elongate, generally tubular member 86.

Depending upon the nature of the toilet seat and the material from which it is constructed, it may possible to cause the device in accordance with this embodiment of my invention to adhere firmly to the bottom of the seat. In other instances, it is often appropriate to utilize a bolt or other suitable pivot member about which the mounting means turns when the elongate, generally tubular member is being moved from the stored position to the active position, and vice versa. Such a bolt can have machine threads thereon, so as to be received in a threaded manner in a member implanted into the underside of the seat, or the bolt can be equipped with threads in the nature of those used on a wood screw, which come to a point.

I claim:

1. A sanitizing spray device for use on a toilet having a seat member, comprising an elongate, generally tubular member having a spray means adjacent one end, means for supplying water at a selected temperature and quantity to said generally tubular member, so that water can be caused to travel for a portion of the length of the tubular member, and then issue as a spray of water from said spray means, mounting means adapted to be located under the seat member for pivotally mounting said generally tubular member at a location intermediate its ends, said mounting means being constructed to permit said generally tubular member to be swung from a recessed position in which it principally resides under the confines of the seat member, to a deployed position in which said spray means is in approximately a central location with respect to the principal aperture of the seat member and the bowl of the toilet, whereby a user sitting on the toilet seat can cause a sanitizing spray of water of selected temperature to be directed upwardly at the private parts of the user, said means for supplying water being connected to said mounting means, latter means serving to distribute water directly to said tubular member, said mounting means having valve means therein to control the flow of water into said generally tubular member and then to pass outwardly through said spray means, which valve means is sensitive to the longitudinal position in which said generally tubular member resides in said mounting means, said valve means being operative to control such flow of water by the user grasping a portion of said generally tubular member, and then pushing it or pulling it with respect to said mounting means in a direction coinciding with the direction of its longitudinal axis.

2. The sanitizing spray device for use on a toilet as recited in claim 1 in which said mounting means is connected to receive water from said means for supplying water, latter means having temperature controlling means near the rear edge of the seat member, within easy reach of the user.

3. The sanitizing spray device for use on a toilet as recited in claim 1 in which said means for supplying water is connected to said mounting means, latter means serving to distribute water directly to said tubular member.

4. The sanitizing spray device for use on a toilet as recited in claim 3 in which said generally tubular member is rotatably mounted in said mounting means, such that said generally tubular member can be rotated by the user about its longitudinal axis, thus to enable the user to direct the spray of water form said spray means in the desired upward or downward direction.

5. A sanitizing spray device for use on a toilet having a seat member, comprising an elongate, generally tubular member having a spray means adjacent one end, means for supplying water at a selected temperature and quantity to said generally tubular member, so that water can be caused to travel for a portion of the length of the tubular member, and then issue as a spray of water from said spray means, mounting means adapted to be located under the seat member for pivotally mounting said generally tubular member at a location intermediate its ends, said mounting means being constructed to permit said generally tubular member to be swung from a recessed position in which it principally resides under the confines of the seat member, to a deployed position in which said spray means is in approximately a central location with respect to the principal aperture of the seat member and the bowl of the toilet, whereby a user sitting on the toilet seat can cause a sanitizing spray of water of selected temperature to be directed upwardly at the private parts of the user, said means for supplying water being connected to said mounting means, latter means serving to distribute water directly to said tubular member, said mounting means having valve means therein to control the flow of water into said generally tubular member and then to pass outwardly through said spray means, which valve means is sensitive to the longitudinal position in which said generally tubular member resides in said mounting means, said valve means being operative to control such flow of water by the user grasping a portion of said generally tubular member, and then pushing it or pulling it with respect to said mounting means in a direction coinciding with the direction of its longitudinal axis.

6. The sanitizing spray device for use on a toilet as recited in claim 5 in which said generally tubular member is rotatably mounted in said mounting means, such that said generally tubular member can be rotated by the user about its longitudinal axis, thus to enable the user to direct the spray of water from spray means in the desired upward or downward direction.

7. The sanitizing spray device for use on a toilet as recited in claim 5 in which said mounting means has temperature controlling means near the rear edge of the seat member, within easy reach of the user.

8. The sanitizing spray device for use on a toilet as recited in claim 5 in which said mounting means serves to distribute water directly to said tubular member.

9. A sanitizing spray device for use on a toilet having a seat member, comprising an elongate, generally tubular member having a spray means adjacent one end, means for supplying water at a selected temperature and quantity to said generally tubular member, so that water can be caused to travel for a portion of the length of the tubular member, and then issue as a spray of water from said spray means, said generally tubular member being rotatably mounted in a mounting means adapted to be located beneath the seat member of the toilet, such that said generally tubular member can be rotated by the user about its longitudinal axis, thus to enable the user to direct the spray of water from said spray means in the desired upward or downward direction. said mounting means having valve means therein to control the flow of water into said generally tubular member and then to pass outwardly through said spray means, which valve means is sensitive to the longitudinal position in which said generally tubular member resides in said mounting means, said valve means being operative to control such flow of water by the user grasping a portion of said generally tubular member, and then pushing it or pulling it with respect to said mounting means in a direction coinciding with the direction of its longitudinal axis.

10. The sanitizing spray device for use on a toilet having a seat member as defined in claim 9, in which said mounting means is pivotally mounted on the underside of the seat member, with said generally tubular member principally residing under the confines of the seat member, but swingable by the user to a deployed position in which said spray means is in approximately a central location with respect to the principal aperture of the seat member and the bowl of the toilet, whereby a user sitting on the toilet seat can cause a sanitizing spray of water of selected temperature to be directed upwardly at the private parts of the user.

11. The sanitizing spray device for use on a toilet as recited in claim 9 in which said mounting means is connected to receive water from said means for supplying water, latter means having temperature controlling means near the rear edge of the toilet seat, within easy reach of the user.

* * * * *